United States Patent [19]

Roth

[11] 4,317,971

[45] Mar. 2, 1982

[54] ADJUSTABLE PRESSURE AND VACUUM LIMIT SWITCH VALVE

[75] Inventor: Verlon C. Roth, Pasadena, Calif.

[73] Assignee: RK Industries, Ontario, Calif.

[21] Appl. No.: 153,601

[22] Filed: May 27, 1980

[51] Int. Cl.[3] ..... H01H 35/34

[52] U.S. Cl. ..... 200/83 J; 200/81.5; 200/82 C

[58] Field of Search ..... 92/5 R, 95, 101; 200/82 R, 82 C, 81.5, 153 T, 81 R, 302, 83 J, 83 S, 83 Q, 83 R, 83 A, 83 SA

[56] References Cited

U.S. PATENT DOCUMENTS

| | | | |
|---|---|---|---|
| 1,273,577 | 7/1918 | Carroll | 200/83 J |
| 2,418,508 | 4/1947 | Goepfrich | 200/82 C |
| 2,803,713 | 8/1957 | Bloom | 200/82 C |
| 3,516,279 | 6/1970 | Maziarka | 200/83 J |
| 3,610,852 | 10/1971 | Lejeune | 200/83 J |
| 3,657,501 | 4/1972 | Hoyt | 200/83 J |
| 3,848,517 | 11/1974 | Hawke | 200/83 J |

*Primary Examiner*—Gerald P. Tolin
*Attorney, Agent, or Firm*—J. L. Jones, Sr.

[57] ABSTRACT

An electrical limit switch valve, having an essentially rigid plastic structural composition, is adapted to conductively secure a fluid flow pipe. A covering flexible elastic membrane diaphragm separates a valve base and piped fluid from a spring loaded ON-OFF electrical switch. The push button detent of the ON-OFF switch is operated normal to the valve bore axis. A valve plug slidably moves on the valve bore axis, the plug bonded at the first valve plug face to the second face of the flexible diaphragm, and the valve plug stem operates the push button detent of the ON-OFF switch. An adjustable actuating first pressurizing spring, coaxially disposed in the valve top housing along the valve bore axis regulates the fluid pressure at which the ON-OFF switch is actuated. An adjustable second pressurizing spring positioned normal to the valve bore axis is adapted to operate on a second spindle controlling the valve plug movement at fluid pressures below atmosphere pressure, in the fluid flow pipe.

4 Claims, 2 Drawing Figures

ADJUSTABLE PRESSURE AND VACUUM LIMIT SWITCH VALVE

BACKGROUND OF THE INVENTION

The adjustable pressure and vacuum limit switch valve of this invention is classified in Class 200 and Subclass 83 DP, 83 J, 83 B, 83 C, and 83 S, and the like.

Hawke, in U.S. Pat. No. 3,848,517 issued Nov. 19, 1974, discloses a pressure sensitive device for operating a switch, the device having a flexible diaphragm displaceable by a communicating high pressure fluid acting on a first diaphragm face. A piston is disposed on the second diaphragm face and is biased by a spring to move in the opposite direction. An arm is actuated by the spring, the arm actuating an electrical switch.

Hoyt, in U.S. Pat. No. 3,657,501 issued Apr. 18, 1972, discloses a pressure actuated device with concentric piston stem actuators. A simple compact system of separate pistons actuate each one of switch respectively, as there are progressive changes of fluid pressure operating on a single flexible diaphragm.

The U.S. Pat. No. 3,516,279 issued on June 23, 1970 to Maziarka discloses a spring biased pressure sensing piston arranged so that the piston assumes a position proportional to the sensed pressure. By varying the bias on the piston, the sensitivity of the piston is varied so the piston assumes a desired position at a predetermined pressure.

The U.S. Pat. No. 2,418,508 issued on Apr. 8, 1947 to Goepfrich discloses a single pressure responsive device designed to selectively operate two electrical switches at different pressure levels.

Carroll discloses in U.S. Pat. No. 1,273,577 issued July 23, 1918, an earlier valve improvement of a water controlling pressure device, embodying a flexible diaphragm transmitting fluid pressure.

SUMMARY OF THE INVENTION

A valve base is secured to a valve top housing, and has a first exterior base face, a parallel second interior base face, and an aperture coaxially located and disposed through the valve base normal to the two base faces. The valve base is adapted and sized to accept and secure a fluid flow pipe conductively secured to the first base face. The second base face has a first face of a covering flexible elastic diaphragm disposed adjacent thereto, sealing off the conduction of the connected fluid flow pipe. The second face of the flexible elastic diaphragm is bonded to the first face of a valve plug, which slidably moves on the valve bore axis. The valve plug slidably moves coaxially in a valve cage, the cage coaxially fixedly secured in the valve top housing. A valve plug first spindle is coaxially normally secured to the second face of the valve plug by the first spindle first terminus. The first spindle has a first annular groove formed thereon adjacent to the first spindle second terminus. The first annular groove interacts with a push button detent of a spring loaded ON-OFF electrical switch, turning the switch ON and OFF. The ON-OFF switch is permanently secured in a peripheral aperture in the valve cage, the push button switch detent moving normal to the valve bore axis, as the valve plug is slidably actuated by the absolute fluid pressure on the flexible diaphragm, moving the valve plug coaxially along the valve bore axis. An actuating first pressurizing spring is coaxially secured in the valve top housing, disposed along the valve bore axis, the spring pressure on the valve plug being adjusted in value by the spring compression rate and an adjustable set screw secured in the valve top housing, exerting an adjustable compressive force on the first spring. An actuating second pressurizing spring is disposed in the valve normal to the valve bore axis and bears compressively on a separate second spindle having one smoothly convexly contoured terminus mating in a matching concavely contoured groove concentrically disposed in and around the base of the valve plug bonded to the second face of the flexible diaphragm. The compressive force on the second pressurizing spring is adjusted in value by a second adjustable set screw secured in and through the side of the valve top housing, the second set screw having a recessed aperture terminus adapted to receiving a portion of the second spring length. The second set screw can be positioned to control the valve plug movement at an absolute value of fluid pressure below normal atmospheric values.

Included in the objects of this invention are:

To provide an adjustable pressure and vacuum limit switch valve which provides secure separation of the electrical switching configuration components and the fluid operating through the switching mechanism.

To provide an adjustable pressure and vacuum limit switch valve having electrical switching action slidably operating along the valve bore axis.

To provide an adjustable limit switch valve operable over both a pressure range above ambient and a vacuum range value below atmospheric pressure.

Other objects and advantages of this invention are taught in the following description and claims.

BRIEF DESCRIPTION OF THE DRAWINGS

The description of this invention is to be read in conjunction with the following drawings.

PREFERRED EMBODIMENT OF THE INVENTION

Figure 1:
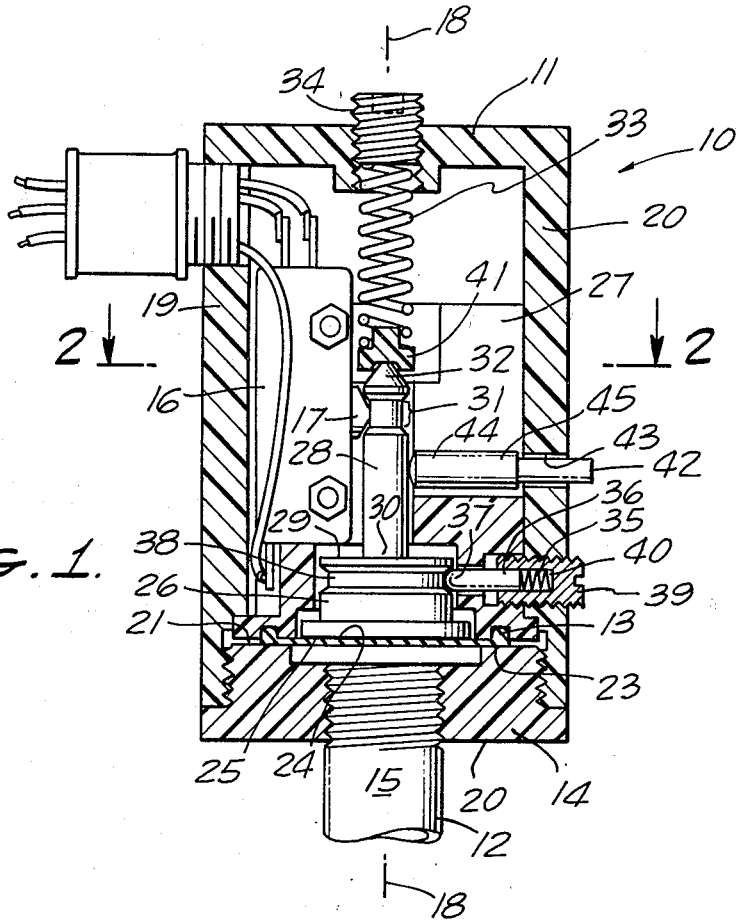
FIG. 1 is an elevational mid-cross sectional view through the limit switch valve of this invention.
Figure 2:
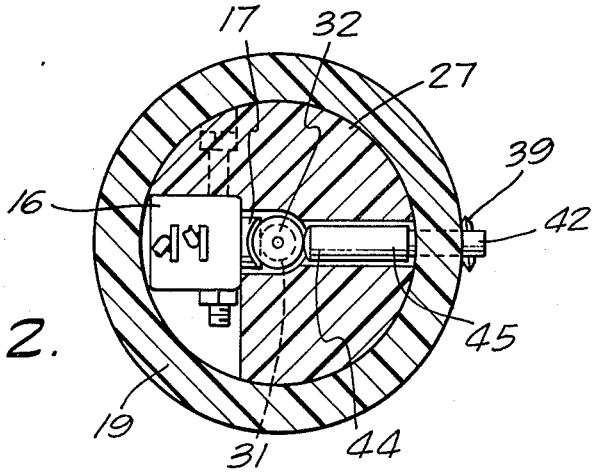
FIG. 2 is a plan view of this valve through 2—2 of FIG. 1.

Referring to FIGS. 1 and 2 in detail, an electrical limit switch 10 valve, having an essentially rigid plastic structural composition 11, is adapted to conductively secure a fluid flow pipe 12, and a covering flexible elastic membrane diaphragm 13 separates the valve base 14 and piped fluid 15 from a spring loaded ON-OFF electrical switch 16. The push button detent 17 of the switch is operated normal to the valve bore axis 18.

The valve base 14 is secured to a valve top housing 19, and has a first exterior base face 20, a parallel second interior base face 21, and an aperture 22 coaxially located and disposed through the valve base 14 normal to the two base faces 20 and 21. The valve base 14 is adapted and sized to accept and secure a fluid flow pipe 12 conductively secured through the first base face 20. The second base face 21 has a first face 23 of the covering flexible elastic diaphragm 13 disposed adjacent thereto, sealing off the conduction of the connected fluid flow pipe 12. The second face 24 of the flexible diaphragm 13 is bonded against the first face 25 of a valve plug 26, which slidably moves on the valve bore axis 18. The valve plug 26 slidably moves coaxially in a valve cage 27, the cage 27 coaxially fixedly secured in the valve top housing 19. A plug first spindle 28 is coaxially normally secured to the second face 29 of the valve plug 26 at the first spindle first terminus 30. The first spindle 28 has a first annular groove 31 formed thereon adjacent to the first spindle second terminus 32. The first annular groove 31 interacts with a push button detent 17 of the spring loaded ON-OFF electrical switch 16, turning the switch ON and OFF. The ON-OFF switch 16 is permanently secured to the valve cage 27, the push button switch detent 17 moving normal to the valve bore axis 18, as the valve plug 26 is slidably actuated by the absolute fluid pressure on the flexible elastic diaphragm 13, moving the valve plug 26 coaxially along the valve bore axis 18. An actuating first pressurizing spring 33 is coaxially compressively secured in the valve top housing 19 disposed along the valve axis 18, the spring pressure on the valve plug 26 being adjusted in value by the spring compression rate and an adjustable set screw 34 secured in the valve top housing 19, exerting an adjustable compressive force on the adjustable spring 33 at compression means 41. An actuating adjustable second pressurizing spring 35 is disposed in the valve normal to the valve bore axis 18 and bears compressively on a separate second spindle 36 having one smoothly convexly contoured terminus 37 mating in a matching concavely contoured groove 38 concentrically disposed on and around the valve plug 26. The compressive force on the second pressurizing spring 35 is adjusted to the needed value by a second adjustable set screw 39 secured in and through the side of the valve top housing 19, the second set screw 39 having a recessed aperture terminus 40 adapted to receiving a portion of the second spring 35 length. The second set screw 39 can be positioned to control the valve plug 26 movement at an absolute value of fluid pressure below normal atmospheric values of about 14.7 psia.

A third reset button spindle 42 is disposed through an aperture 43 of top housing 19, normal to the valve bore axis 18, the reset button spindle 42 bearing on the valve plug first spindle 28. On pressurizing by human finger the first terminus 44 of the third spindle 42 against the first spindle 28, the push button detent 17 is operated in switch 16, reversing the switch 16 electrical circuit as required. The reset button spindle 42 can be adaptively sized adjacent its second terminus 45 to a reduced spindle 42 diameter which is easily retained in the selectively sized aperture 43.

The rigid plastic composition utilized in fabrication of the valve component parts can be rigid polyvinyl chloride, rigid polyethylene, polypropylene, polytetrofluoroethylene, polytrifluoroethylene, ABS polymer and the like rigid non-electrically conducting and non-chemically reactive polymers. The thicknesses and shapes of the components of the valve are proportioned to withstand fluid pressure in the valve ranging from 0 to 100 psia and the like.

The preferred modification of this limit switch valve embodies a flexible elastic membrane diaphragm 13. A further valve modification can embody an O-ring replacement for the diaphragm 13, compressively disposed between the valve base 14 and the valve cage 27. A second further O-ring and channel is disposed in and around the base of the slidable valve plug 26, below and parallel to groove 38, providing a fluid seal for valve plug 26 against the piped fluid 15.

In preferred operation the limit switch valve 10 is connected to a piped fluid 15 at the aperture 22, the fluid 15 exerting pressure on the diaphragm 13. At a predetermined elevated pressure, determined by the degree of compression of spring 33 by set screw 34, the fluid 15 acting on the diaphragm 13 moves the valve plug 26 toward the set screw 34, and the plug spindle 28 moves toward set screw 34, actuating the spring loaded switch push button detent 17 and operating the ON-OFF switch 16. The switch 16 is wired to be normally OFF or ON, as required. The reset button 45 can be normally operated to effectively bend the first spindle 28, resetting the switch 16 by actuating push button detent 17.

The seating pressure of the second spindle 36 at its terminus 37 in the mating contoured groove 38 of the valve plug 26 can be regulated by the pressure exerted by set screw 39 on the second spring 35. At the predetermined pressure value, lower than the normal atmospheric pressure of 14.7 psia, the diaphragm 13 can move downward toward pipe 12, the valve plug 26 disengaging at the concavely contoured groove 38 from the convexly contoured terminus 37 of the second spindle 36. Thus the adjustable pressure and vacuum limit switch valve can be operated in a pressure range of 0 to 100 psia, with variable pressure actuating switch adjustments.

Many modifications in the adjustable pressure and vacuum limit switch valve can be made in the light of my teachings. It is understood that within the scope of the claims, the invention can be practiced otherwise than as described.

I claim:

1. An adjustable pressure and vacuum limit switch valve comprising:

a valve base having a pair of parallel exterior and interior plane base faces, and an aperture disposed through said valve base normal to said pair of plane base faces, said exterior plane face adapted and sized to conductively accept and secure a fluid flow pipe to said exterior plane face, a flexible elastic composition diaphragm having a first diaphragm face conductively coaxially sealed to said interior face of said valve base, sealing off the conduction of said fluid flow pipe, a valve top housing having a hollow dome interior, having a threaded top aperture coaxially disposed through the housing face opposed to said valve base, and having securing means conductively sealing said valve base to said valve top housing, a tubular valve cage sized and secured in said valve top housing, said valve cage having a flat first cage terminus securely disposed on the second diaphragm face and forming a second diaphragm seal, said valve cage having a second cage terminus disposed inside said valve top housing, said valve cage having an integral ledge coaxially formed on said valve cage coterminous with said flat first cage terminus, said integral ledge mating with a valve top housing coaxial ledge disposed adjacent to the securing means sealing said valve base to said valve top housing, said valve cage having a symmetrical coaxial cage aperture therein extending from said first cage terminus to said second cage terminus, said coaxial cage aperture symmetrically disposed along the valve bore axis, said cage aperture having an expanded volume at said second cage terminus and an expanded stepped volume at said first cage terminus, a valve plug having a mating symmetrical plug step adapted and sized to fit in and mate with said expanded stepped volume disposed at said first cage terminus, the first face of said valve plug sealed against said second face of aforesaid flexible diaphragm, said valve plug slidably moving coaxially in said valve cage in response to varying fluid pressure in said fluid flow pipe, a plug first spindle coaxially normally secured to the second face of said valve plug by the first spindle first terminus, and an annular groove formed around said first spindle adjacent to the second terminus of said first spindle, said first spindle adaptively sized to slide in said valve cage symmetrical coaxial cage aperture, a first pressurizing spring means secured in said valve top housing along said valve bore axis having one first spring means terminus bearing on said first spindle second terminus, and a second terminus of said first spring means bearing on an adjustable set screw secured in said valve top housing threaded aperture, an ON-OFF electrical switch having permanent securing means attaching said switch to a peripheral aperture in said valve cage, said aperture disposed parallel to said valve bore axis and along the exterior perimeter of said valve cage, said switch having a spring loaded push button detent extending from the switch body normally to said valve bore axis and into said annular groove of said first spindle, said ON-OFF switch electrically conductively wired normally ON and OFF as selected, said push button detent selectively conductively switching as required on engagement of said push button detent into and out of said annular groove of said first spindle on slidably moving said valve plug in said valve cage aperture, as fluid pressure varies on said flexible diaphragm.

2. In the adjustable pressure and vacuum limit switch valve of claim 1, the further improvement wherein, an actuating adjustable second pressurizing spring is disposed in said limit switch valve normal to said valve bore axis, said second spring bearing compressively on a separate second spindle having one smoothly convexly contoured terminus, a concavely contoured groove concentrically disposed on and around said valve plug adjacent to the second face of said valve plug, said contoured groove mating with said separate second spindle convexly contoured terminus, and, a second adjustable set screw secured in and through the side of said valve top housing, said second set screw having a recessed aperture terminus adapted to receive a portion of the second pressurizing spring length, whereby said second set screw can be positioned to control the valve plug movement toward said valve base at an absolute value of fluid pressure below normal atmospheric value of about 14.7 psia.

3. In the adjustable pressure and vacuum limit switch valve of claim 1, the further improvement wherein, a reset button third spindle is disposed through a reduced diameter aperture in said top housing normal to said valve bore symmetry axis, said reset button third spindle having a first terminus bearing against said first spindle, said third spindle having a reduced spindle diameter adjacent to and extending exteriorly through the reduced diameter aperture in said valve top housing, providing a third spindle reset button operable by human fingers on pushing said first terminus of said third spindle against said first spindle and operating said push button detent.

4. An adjustable pressure and vacuum limit switch valve comprising:

a valve base having a pair of parallel exterior and interior plane base faces, and an aperture disposed through said valve base normal to said pair of plane base faces, said exterior plane face adapted and sized to conductively accept and secure a fluid flow pipe to said exterior plane face, a flexible elastic composition diaphragm having a first diaphragm face conductively coaxially sealed to said interior face of said valve base, sealing off the conduction of said fluid flow pipe, a valve top housing having a hollow dome interior, having a threaded top aperture coaxially disposed through the housing face opposed to said valve base, and having securing means conductively sealing said valve base to said valve top housing, a tubular valve cage sized and secured in said valve top housing, said valve cage having a flat first cage securely disposed on the second diaphragm face and forming a second diaphragm seal, said valve cage having a second cage terminus disposed inside said valve top housing, said valve cage having an integral ledge coaxially formed on said valve cage coterminus with said flat first cage terminus, said integral ledge mating with a valve top housing coaxial ledge disposed adjacent to the securing means sealing said valve base to said valve top housing, said valve cage having a symmetrical coaxial cage aperture therein extending from said first cage terminus to said second cage terminus, said coaxial cage aperture symmetrically disposed along the valve bore axis, said cage aperture having an expanded volume at said second cage terminus and an expanded stepped volume at said first cage terminus, a valve plug having a mating symmetrical plug step adapted and sized to fit in and mate with said expanded stepped volume disposed at said first cage terminus, the first face of said valve plug sealed against said second face of aforesaid flexible diaphragm, said valve plug slidably moving coaxially in said valve cage in response to varying fluid pressure in said fluid flow pipe, a plug first spindle coaxially normally secured to the second face of said valve plug by the first spindle first terminus, and an annular groove formed around said first spindle adjacent to the second terminus of said first spindle, said first spindle adaptively sized to slide in said valve cage symmetrical coaxial cage aperture, a first pressurizing spring means secured in said valve top housing along said valve bore axis having one first spring means terminus bearing on said first spindle second terminus, and a second terminus of said first spring means bearing on an adjustable set screw secured in said valve top housing threaded aperture, an ON-OFF electrical switch having permanent securing means attaching said switch to a peripheral aperture in said valve cage, said aperture disposed parallel to said valve bore axis and along the exterior perimeter of said valve cage, said switch having a spring loaded push button detent extending from the switch body normally to said valve bore axis and into said annular groove of said first spindle, said ON-OFF switch electrically conductively wired normally ON and OFF as selected, said push button detent selectively conductively switching as required on engagement of said push button detent into and out of said annular groove of said first spindle on slidably moving said valve plug in said valve cage aperture, as fluid pressure varies on said flexible diaphragm, an actuating adjustable second pressurizing spring is disposed in said limit switch valve normal to said valve bore axis, said second spring bearing compressively on a separate second spindle having one smoothly convexly contoured terminus, a concavely contoured groove concentrically disposed on and around said valve plug adjacent to the second face of said valve plug, said contoured groove mating with said separate second spindle convexly contoured terminus, a second adjustable set screw secured in and through the side of said valve top housing, said second set screw having a recessed aperture terminus adapted to receive a portion of the second pressurizing spring length, whereby said second set screw can be positioned to control the valve plug movement toward said valve base at an absolute value of fluid pressure below normal atmospheric value of about 14.7 psia, and, a reset button third spindle is disposed through a reduced diameter aperture in said top housing normal to said valve bore symmetry axis, said reset button third spindle having a first terminus bearing against said first spindle, said third spindle having a reduced spindle diameter adjacent to and extending exteriorly through the reduced diameter aperture in said valve top housing, providing a third spindle reset button operable by human fingers on pushing said first terminus of said third spindle against said first spindle and operating said push button detent.

* * * * *